US005719338A

United States Patent [19]

Magalski et al.

[11] Patent Number: 5,719,338

[45] Date of Patent: Feb. 17, 1998

[54] METHOD AND APPARATUS FOR PROVIDING AN INDICATION OF COMPACTION IN A VIBRATION COMPACTION VEHICLE

[75] Inventors: Edward D. Magalski, York; Mark J. Stang, Boiling Springs, both of Pa.

[73] Assignee: Ingersoll-Rand Company, Woodlciff Lake, N.J.

[21] Appl. No.: 547,212

[22] Filed: Oct. 24, 1995

[51] Int. Cl.[6] ..... G01H 1/00; E01C 19/38

[52] U.S. Cl. ..... 73/66; 404/117; 404/133.05; 364/508; 364/551.02

[58] Field of Search ..... 73/572, 573, 570, 73/784, 78, 660, 658; 404/133.05, 117; 364/505, 506, 508, 551.02, 571.02, 571.04, 571.07, 571.08

[56] References Cited

U.S. PATENT DOCUMENTS

| | | | |
|---|---|---|---|
| 3,797,954 | 3/1974 | Harris | 404/117 |
| 4,103,554 | 8/1978 | Thurner | 73/573 |
| 4,127,351 | 11/1978 | Vural | 404/72 |
| 4,149,253 | 4/1979 | Paar et al. | 364/505 |
| 4,212,071 | 7/1980 | Dortu | 364/505 |
| 4,348,901 | 9/1982 | Vural et al. | 73/594 |
| 4,734,846 | 3/1988 | Konig | 364/153 |
| 4,870,601 | 9/1989 | Sandström | 364/550 |
| 5,164,641 | 11/1992 | Quibel et al. | 318/128 |
| 5,177,415 | 1/1993 | Quibel et al. | 318/128 |

*Primary Examiner*—Hezron E. Williams
*Assistant Examiner*—Richard A. Moller
*Attorney, Agent, or Firm*—John J. Selko

[57] ABSTRACT

A vibratory compactor includes front and rear frame portions driven by a hydraulic motor and a vibration mechanism on at least one of the frame portions also driven by a hydraulic motor. Speed sensors on the vehicle determine the speed of the hydraulic motors, send a signal to a microprocessor on the vehicle which is programmed to convert the signals to indicate the vibrations per unit of longitudinal travel of the vehicle and to display the amount of vibrations on an indicator for the benefit of the operator.

11 Claims, 2 Drawing Sheets

METHOD AND APPARATUS FOR PROVIDING AN INDICATION OF COMPACTION IN A VIBRATION COMPACTION VEHICLE

BACKGROUND OF THE INVENTION

This invention relates generally to a method and apparatus for indicating the approximate degree of compaction in a bed of material from a vibratory compactor, and more particularly to a method and apparatus utilizing signals from speed sensing devices on the hydraulic motors used to propel the compactor and to impart vibratory impacts to the material.

Prior art devices for determining the degree of compaction of material rely on monitoring a specific characteristic of the material, or on monitoring acceleration occurring when the working part of the vibrating compactor strikes the material. These prior art devices are complicated and expensive to install and maintain.

The foregoing illustrates limitations known to exist in present vibration indicating devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus for providing an indication of compaction in a vibratory compaction vehicle comprising: a first vehicle frame portion mounted on a front driving member rotatably connected to a first transverse axle; a second vehicle frame portion mounted on a rear driving member rotatably connected to a second transverse axle parallel to the first axle, the first and second frame portions being connected together; propulsion means for propelling the vehicle including a first hydraulic motor means for rotating one of the driving members; vibration means mounted on the one driving member for causing vibratory impacts to be transmitted by the one driving member to material to be compacted thereunder; second hydraulic motor means for driving the vibration means; and indicating means for determining and indicating the number of vibratory impacts transmitted per unit of longitudinal travel of the vehicle.

The foregoing and other aspects will become apparent from the following detailed description of the invention when considered in conjunction with the accompanying drawing figures.

BRIEF DESCRIPTION OF THE DRAWING FIGURES

FIG. 1 is a schematic, partly cross-sectional elevational side view of the apparatus of this invention;

FIG. 2 is a schematic, partly cross-sectional plan view of the apparatus of this invention, with a vibration indicator gauge schematically connected thereto; and FIG. 3 is a block diagram of the signal flow of the present invention in accordance with which signals are generated and processed, to activate a gauge to indicate the number of vibrations per unit distance of travel of a compactor of this invention.

DETAILED DESCRIPTION

Figure 2:
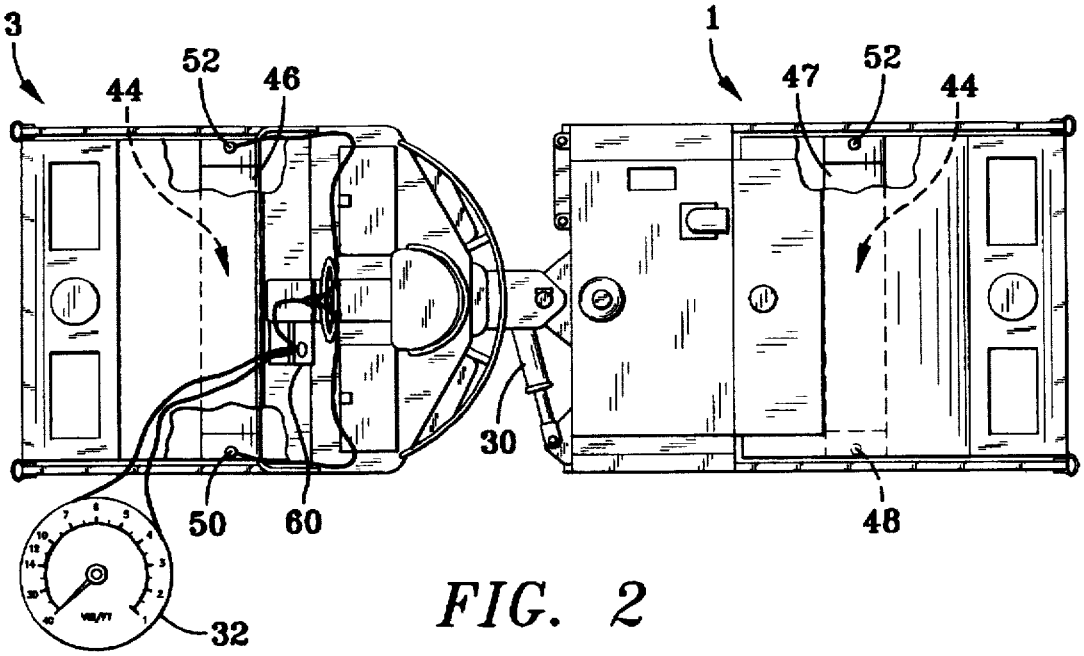
Figure 1:
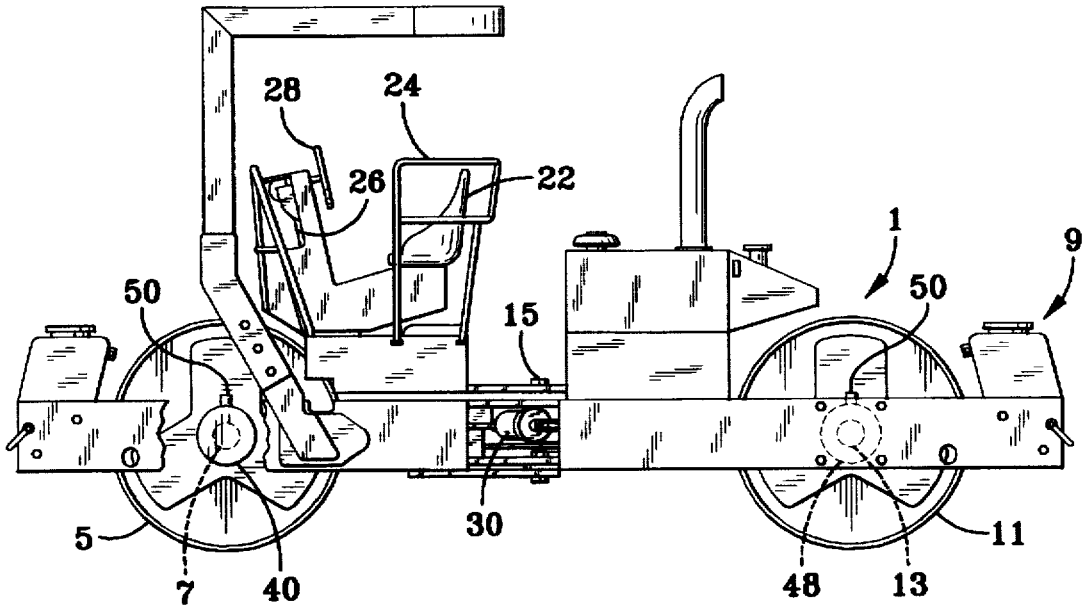

FIGS. 1 and 2 show a conventional mobile asphalt campacting vehicle 1 having a first vehicle frame portion 3 mounted on a steel drum front driving member 5, which is rotatably connected to a first transverse axle 7, as is well known. A second vehicle frame portion 9 is mounted on a rear steel drum driving member 11, which is also rotatably connected to a second transverse axle 13 parallel to axle 7. First and second frame portions are connected to each other by an articulated joint 15, as is well know, although a rigid connection can also be used. Carried on first frame portion is an operator station of conventional design, including a seat 22, a safety rail 24, an instrument console 26, and a steering wheel 28 whereby steering mechanism 30 is actuated. Mounted on console 26 is a vibration indicator gauge 32, as described hereinafter.

Propulsion means for propelling the vehicle includes first hydraulic motor 40 for rotating front driving member 5. Motor 40 and its operative connection to driving member 5 is conventional and well known.

Mounted on front driving member 5 is a conventional rotary vibration means 44 for causing vibratory impacts to be transmitted by front driving member 5 to material to be compacted thereunder. Vibration means 44 is driven by a second hydraulic motor 46. Motor 46 and its operative connection to driving member 5 are conventional and well known.

It is optional to provide a third hydraulic motor 48 for rotating rear driving member 11. It is also optional to provide a vibration means 44 on rear driving member 11, driven by fourth hydraulic motor 47.

Means for determining and indicating the number of vibratory impacts transmitted per unit of longitudinal travel of vehicle 1 will now be described. A first speed sensing device 50 senses the rotational speed of first hydraulic motor 40 and generates a first electrical signal proportional thereto. A second speed sensing device 52 senses the rotational speed of second hydraulic motor 46 and generates a second electrical signal proportional thereto. Microcontroller means 60 is electronically connected to speed sensors 50, 52 and can be an integral part of gage 32. Microcontroller means 60 includes a first memory means 62 (FIG. 3), which can be a microchip, programmed to store a predetermined data table or computing means for converting the magnitude of first electrical signal into a distance of longitudinal travel per unit time (preferably feet per minute) of vehicle 1. The conversion rate can be worked out by trial and error, and will depend on the operating and design parameters of the motor 40, and vehicle 1.

Microcontroller means 60 also includes a second memory means 64, which can be a microchip, programmed to store a predetermined data table or computing means for converting the magnitude of second electrical signal into a number of vibratory impacts per unit time (preferably impacts per minute). The conversion rate can be worked out by trial and error, and will depend on the operating and design parameters of the motor 46 and vehicle 1.

Microcontroller 60 is also preprogrammed with a computing means 65, which can be a microchip, to compute an amount of vibratory impacts per unit distance of travel (preferable impacts per foot). Microcontroller 60 generates a third electrical signal proportional to this amount, and transmits it to gauge 32. This information permits the operator to have a general indication of the amount of compaction taking place. As the operator gains experience with the vehicle and material being compacted, he can estimate the rate of travel to be used for an estimated amount of compaction, with a very simple and inexpensive apparatus.

Figure 3:
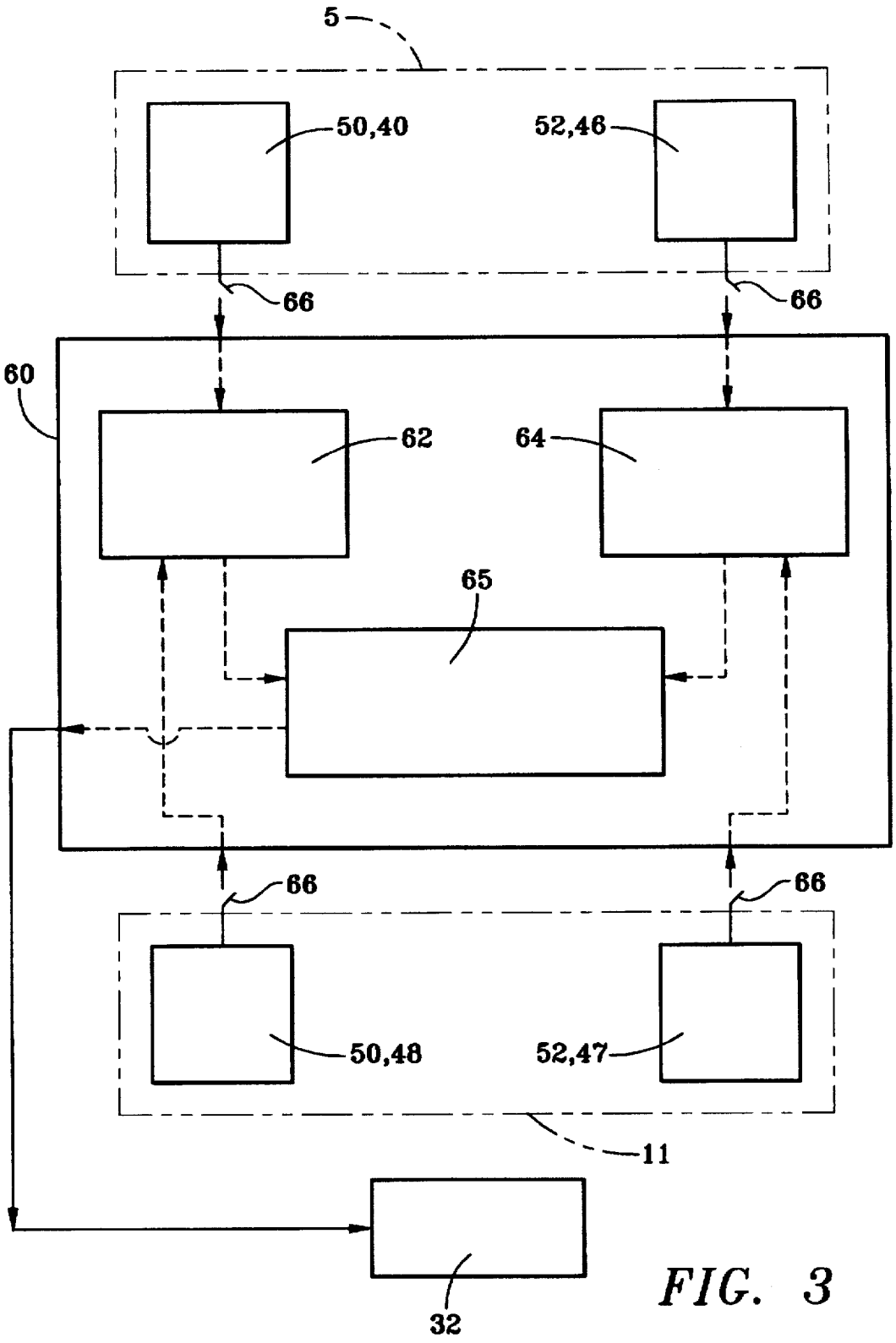

FIG. 3 shows a schematic block diagram of the signal flow of the present invention in accordance with which signals are generated and processed, to activate gauge 32 to indicate the number of vibrations per unit distance of travel of a compactor of this invention. FIG. 3 shows an arrangement having a motor 40, 48 on members 5, 11, respectively, plus a vibration means 44 (with motors 46, 47) on front and rear driving members 5, 11, with switches 66 in the circuits to turn selected elements off and on, at the operator's discretion.

The major elements of this apparatus are readily available. For motor 40, 48 we prefer a motor from Sauer Sundstrand Company, series 90 designation or a motor from Poclain Hydraulics, Inc., designation T36. For motor 46, 47 we prefer a series 90 motor from Sauer Sundstrand Company. For speed sensor 50, 52, we prefer speed sensor part number KPPC124 for the Sauer Sundstrand Company motors and part number 002141330H for the Poclain Hydraulics, Inc. motors. For microcontroller 60, we prefer an RCA Corporation microcontroller, part number CA30.

Having described the invention, what is claimed is:

1. Apparatus for providing an indication of compaction in a vibratory compaction vehicle comprising:

(a) a first vehicle frame portion mounted on a first driving member rotatably connected to a first transverse axle;

(b) a second vehicle frame portion mounted on a second driving member rotatably connected to a second transverse axle parallel to said first axle, said first and second frame portions being connected together;

(c) propulsion means for propelling said vehicle including a first hydraulic motor means for rotating said first driving member;

(d) vibration means mounted on said first driving member for causing vibratory impacts to be transmitted by said first driving member to material to be compacted thereunder;

(e) second hydraulic motor means for driving said vibration means;

(f) means for sensing a rotational speed of said first and second hydraulic motors; and (g) indicating means, using said sensed rotational speed of said first and second hydraulic motors, for determining and indicating the number of vibratory impacts transmitted per unit of longitudinal travel of said vehicle.

2. The vehicle of claim 1 wherein said indicating means further comprises:

(a) a first speed sensing means for sensing the rotational speed of said first hydraulic motor and generating a first electrical signal proportional thereto;

(b) a second speed sensing means for sensing the rotational speed of said second hydraulic motor and generating a second electrical signal proportional thereto;

(c) microcontroller means electrically connected to said first and second speed sensing means, responsive to said first and second electrical signals, said microcontroller means including:

(i) first memory means for converting a magnitude of said first electrical signal to a distance of longitudinal travel per unit time of said vehicle;

(ii) second memory means for converting a magnitude of said second electrical signal to a number of vibratory impacts per unit time; and (iii) computing means responsive to inputs from said first and second memory means, for computing an amount of vibrations per unit distance of longitudinal travel of said vehicle and for generating a third electrical signal proportional thereto; and (d) gauge means for displaying said third electrical signal on a visual indicator for the benefit of an operator of said vehicle.

3. The vehicle of claim 2 wherein said first frame portion is connected to said second frame portion through an articulated joint.

4. The vehicle of claim 3 wherein said first driving member includes a drum having an outer peripheral surface that is substantially smooth.

5. The vehicle of claim 4 wherein said second driving member includes a drum having an outer peripheral surface that is substantially smooth.

6. The vehicle of claim 5 further comprising:

(a) third hydraulic motor means for rotating said second driving member;

(b) second vibration means mounted on said second driving member for causing vibratory impacts to be transmitted by said second driving member to material to be compacted thereunder, said second vibration means being driven by a fourth hydraulic motor; and (c) means for electrically disconnecting said first vibration means from said indicating means and for electrically connecting said indicating means to said second vibration means, for determining and indicating the number of vibratory impacts transmitted per unit of longitudinal travel of said vehicle by said second vibration means.

7. The vehicle of claim 6 wherein said indicating means further comprises:

(a) a third speed sensing means for sensing the rotational speed of said third hydraulic motor and generating a fourth electrical signal proportional thereto;

(b) a fourth speed sensing means for sensing the rotational speed of said fourth Hydraulic motor and generating a fifth electrical signal proportional thereto;

(c) said microcontroller means electrically connected to said third and fourth speed sensing means, responsive to said fourth and fifth electrical signals, said microcontroller means including:

(i) said first memory means converting said fourth electrical signal to a distance of longitudinal travel of said vehicle per unit time;

(ii) said second memory means converting a magnitude of said fifth electrical signal to a number of vibratory impacts per unit time; and (iii) said computing means computing an amount of vibrations per unit distance of travel of said vehicle and generating a sixth electrical signal proportional thereto; and (d) said gauge means displaying said sixth electrical signal on a visual indicator for the benefit of an operator of said vehicle.

8. A method for providing an indication of compaction in a vibration compaction vehicle comprising:

(a) providing a first vehicle frame portion mounted on a front driving member rotatably connected to a first transverse axle;

(b) providing a second vehicle frame portion mounted on a rear driving member rotatably connected to a second transverse axle parallel to said first axle, said first and second frame portions being connected together;

(c) providing propulsion means for propelling said vehicle including first hydraulic motor means for rotating said front driving member;

(d) causing vibratory impacts to be transmitted by said front driving member to material to be compacted thereunder, said vibratory impacts being caused by a second hydraulic motor; and (e) indicating the number of vibratory impacts transmitted per unit of longitudinal travel of said vehicle.

9. The method of claim 8 further comprising:

(a) sensing the rotational speed of said first hydraulic motor and generating a first electrical signal proportional thereto;

(b) sensing the rotational speed of said second hydraulic motor and generating a second electrical signal proportional thereto;

(c) converting said first electrical signal to a distance of longitudinal travel per unit time of said vehicle;

(d) converting said second electrical signal to a number of vibratory impacts per unit time;

(e) computing an amount of vibrations per unit distance of longitudinal travel of said vehicle; and (f) displaying said amount of vibrations on a visual indicator for the benefit of an operator of said vehicle.

10. The method of claim 9 further comprising:

(a) providing a third hydraulic motor means for rotating said rear driving member;

(b) causing vibratory impacts to be transmitted by said rear driving member to material to be compacted thereunder, said vibratory impacts being caused by a fourth hydraulic motor means; and (c) indicating the number of vibratory impacts transmitted per unit of longitudinal travel of said vehicle by said rear driving member.

11. The method of claim 10 further comprising:

(a) sensing the rotational speed of said third hydraulic motor and generating a third electrical signal proportional thereto;

(b) sensing the rotational speed of said fourth hydraulic motor and generating a fourth electrical signal proportional thereto;

(c) converting said third electrical signal to a distance of longitudinal travel of said vehicle per unit time;

(d) converting said fourth electrical signal to a number of vibratory impacts per unit time;

(e) computing an amount of vibrations per unit distance of travel of said vehicle; and (f) displaying said amount of vibrations on a visual indicator for the benefit of an operator of said vehicle.

* * * * *